US008264429B2

(12) United States Patent
Lee et al.

(10) Patent No.: US 8,264,429 B2
(45) Date of Patent: Sep. 11, 2012

(54) ORGANIC LIGHT-EMITTING DIODE (OLED) DISPLAY APPARATUS AND METHOD OF DRIVING THE SAME

(75) Inventors: Dong-Woo Lee, Suwon-si (KR); Sung-Un Park, Suwon-si (KR)

(73) Assignee: Samsung Display Co., Ltd., Yongin, Gyunggi-Do (KR)

( * ) Notice: Subject to any disclaimer, the term of this patent is extended or adjusted under 35 U.S.C. 154(b) by 791 days.

(21) Appl. No.: 12/081,217

(22) Filed: Apr. 11, 2008

(65) Prior Publication Data

US 2009/0027311 A1 Jan. 29, 2009

(30) Foreign Application Priority Data

Jul. 23, 2007 (KR) ..... 10-2007-0073474

(51) Int. Cl.
*G09G 3/30* (2006.01)

(52) U.S. Cl. ..... 345/76; 345/211

(58) Field of Classification Search ..... 345/21, 345/76, 77, 82, 84, 98, 99, 100, 212, 213, 345/214

See application file for complete search history.

(56) References Cited

U.S. PATENT DOCUMENTS

| | | | | |
|---|---|---|---|---|
| 6,858,992 | B2 | 2/2005 | Park et al. | |
| 7,348,942 | B2 | 3/2008 | Jo | |
| 2002/0047827 | A1 | 4/2002 | Koyama et al. | |
| 2002/0060673 | A1 | 5/2002 | Noritake et al. | |
| 2003/0011586 | A1 | 1/2003 | Nakajima | |
| 2003/0151577 | A1 | 8/2003 | Morita | |
| 2003/0169590 | A1* | 9/2003 | Sorli et al. | 362/154 |
| 2003/0214469 | A1 | 11/2003 | Kageyama et al. | |
| 2004/0179005 | A1 | 9/2004 | Jo | |
| 2005/0179039 | A1 | 8/2005 | Nonaka | |
| 2005/0285825 | A1* | 12/2005 | Eom et al. | 345/76 |
| 2006/0061291 | A1 | 3/2006 | Lee et al. | |
| 2006/0139251 | A1 | 6/2006 | Morosawa et al. | |
| 2007/0126683 | A1* | 6/2007 | Sung et al. | 345/92 |

FOREIGN PATENT DOCUMENTS

| | | | |
|---|---|---|---|
| JP | 2001-092402 | A | 4/2001 |
| JP | 2002-175034 | A | 6/2002 |
| JP | 2002-175062 | A | 6/2002 |
| JP | 2002-202765 | A | 7/2002 |
| JP | 2003-005715 | A | 1/2003 |

(Continued)

OTHER PUBLICATIONS

Japanese Office Action in JP 2008-099635, dated Feb. 22, 2011 (Lee et al.).

(Continued)

*Primary Examiner* — Amare Mengistu
*Assistant Examiner* — Stacy Khoo
(74) *Attorney, Agent, or Firm* — Lee & Morse, P.C.

(57) ABSTRACT

An organic light-emitting diode (OLED) display apparatus, including a control unit to receive an image signal and to generate a frame-based image data signal and a frame identification signal based at least in part on the received image signal, the frame identification signal being synchronized with the frame-based image data signal, a driving voltage supply unit to generate a first voltage for a switching unit and a second voltage for a display unit, and a switching unit to receive the first voltage and the frame identification signal and to supply the first voltage for the display unit based at least in part on the frame identification signal.

11 Claims, 4 Drawing Sheets

FOREIGN PATENT DOCUMENTS

| | | | |
|---|---|---|---|
| JP | 2003-084722 | A | 3/2003 |
| JP | 2003-233357 | A | 8/2003 |
| JP | 2004-177796 | A | 6/2004 |
| JP | 2004-252104 | A | 9/2004 |
| JP | 2005-070487 | A | 3/2005 |
| JP | 2005-227529 | A | 8/2005 |
| KR | 10-2004-0019207 | A | 3/2004 |
| KR | 10-2004-0074601 | A | 8/2004 |
| KR | 10-2005-0123325 | A | 12/2005 |

OTHER PUBLICATIONS

Japanese Office Action in JP 2008-099635, dated Jun. 14, 2011 (Lee, et al.).

Japanese Office Action in JP 2008-099635, dated Oct. 18, 2011 (Lee, et al.).

* cited by examiner

ORGANIC LIGHT-EMITTING DIODE (OLED) DISPLAY APPARATUS AND METHOD OF DRIVING THE SAME

BACKGROUND OF THE INVENTION

1. Field of the Invention

The present invention relates to an organic light-emitting diode (OLED) display apparatus and a method of driving the same. More particularly, the present invention relates to an OLED display apparatus and a method of driving the OLED display apparatus that may reduce or prevent a motion blur phenomenon in the OLED display apparatus.

2. Description of the Related Art

In recent years, various flat panel display apparatuses have been developed, including liquid crystal displays (LCDs), field emission displays (FEDs), plasma display panels (PDPs), light-emitting diode (LED) displays. Among these conventional flat panel display apparatuses, displays capable of maintaining a display of images in the absence of continuously-updated image data are referred to as "hold type displays". For example, a hold type display may maintain a display of an image during an entire frame period of received image data. Active matrix organic light-emitting diode (AMOLED) displays are an example of a hold type display.

In conventional hold type display apparatuses such as those described above, each pixel includes at least one capacitor to supply current to the pixel during each frame period of received image data. In other words, in conventional hold type display apparatuses, a capacitor is charged with a voltage, and current is supplied to a pixel using the charged voltage.

In conventional hold type display apparatuses such as described above, a motion blur phenomenon may occur. A motion blur phenomenon occurs when a current corresponding to a voltage stored in a capacitor is continuously supplied to each pixel of a hold type display apparatus for each frame of image data, and an image includes moving images. The moving images may be blurred on the display apparatus due to an afterimage effect resulting from the current being continuously supplied to the pixels of the hold type display apparatus during an entire frame period of image data. Such a motion blur phenomenon lowers the display quality of a hold type display apparatus. A need, therefore, exists for a display apparatus that addresses one or more limitations and problems of the conventional art.

SUMMARY OF THE INVENTION

The present invention provides an OLED display apparatus and a method of operation that addresses one or more limitations and problems of the conventional art.

It is therefore a feature of an embodiment of the present invention to provide an OLED display apparatus that addresses one or more limitations and problems of the conventional art.

It is therefore another feature of an embodiment of the present invention to provide a method of operating an OLED display apparatus that may reduce or prevent a motion blur phenomenon in the OLED display apparatus.

At least one of the above and other features of the present invention may be realized by providing an OLED display apparatus, including a control unit to receive an image signal and to generate a frame-based image data signal and a frame identification signal based at least in part on the received image signal, the frame identification signal being synchronized with the frame-based image data signal, a driving voltage supply unit to generate a first voltage for a switching unit and a second voltage for a display unit, and a switching unit to receive the first voltage and the frame identification signal and to supply the first voltage for the display unit based at least in part on the frame identification signal.

The frame identification signal may include data to identify a starting point of each frame included in the frame-based image data signal. Further, the switching unit may be further adapted to supply the first voltage to the display unit. The switching unit may be further adapted to supply the first voltage to the display unit when the frame identification signal indicates that the frame-based image data signal is not at a starting point of a frame.

The driving voltage supply unit may include a power source to supply an input voltage to a voltage converter, and a voltage converter to convert the input voltage from the power source to a first voltage higher than the input voltage and a second voltage lower than the input voltage. The data to identify a starting point of each frame included in the frame-based image data signal may include a voltage signal that has one of a first level voltage or a second level voltage based at least in part on the frame-based image data signal.

The switching unit may be adapted to enter an "off" state in response to the frame identification signal having a first level voltage, and is adapted to enter an "on" state in response to the frame identification signal having a second level voltage. The display unit may include a plurality of pixels. Further, each of the pixels may include a driving thin film transistor to supply a current to respective OLEDs.

At least one other of the above and other features of the present invention may be realized by providing a method of driving an OLED display apparatus, the method including generating a frame-based image data signal and a frame identification signal based at least in part on an image input signal, the frame identification signal identifying a starting point of each frame included in the frame-based image data signal, providing the frame-based image data signal to a display unit, and alternating a supply of a driving voltage to the display unit in response to the frame identification signal such that a driving voltage is supplied to the display unit only if the frame-based image data signal provided to the display unit is not at a starting point of a frame included in the frame-based image data signal.

The method of driving the OLED display apparatus may further include displaying images corresponding to the frame-based image data signal when the driving voltage is supplied to the display unit. The frame identification signal may include data to identify a starting point of each frame included in the frame-based image data signal.

The data to identify a starting point of each frame included in the frame-based image data signal may include a voltage signal that has one of a first level voltage or a second level voltage based at least in part on the frame-based image data signal. Alternating the supply of the driving voltage may further include not providing the driving voltage in response to the frame identification signal having a first level voltage, and providing the driving voltage in response to the frame identification signal having a second level voltage. Further, another driving voltage may be continuously supplied to the display unit.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
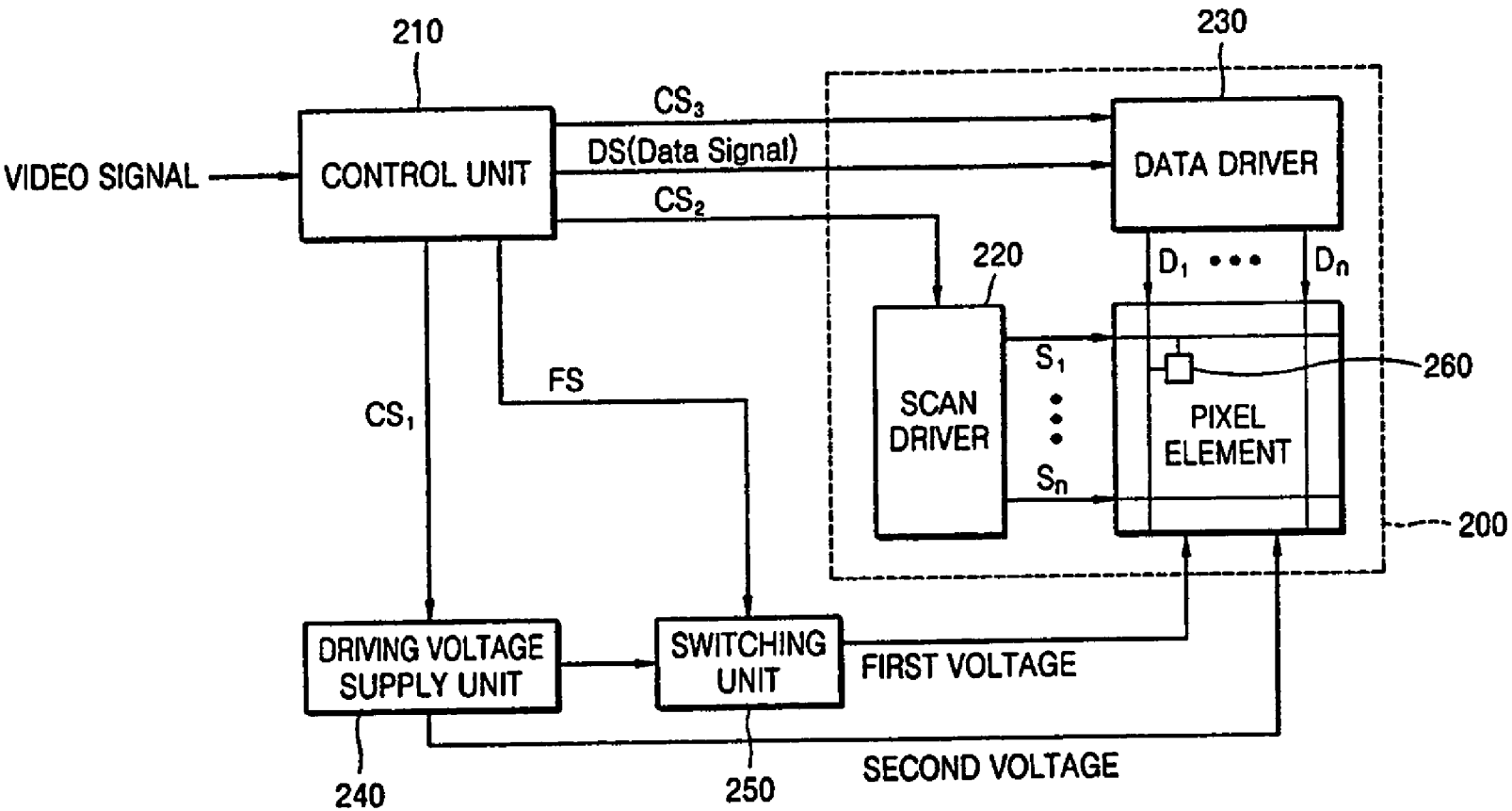
FIG. 1 illustrates a schematic block diagram of an OLED display apparatus according to an embodiment of the present invention.

Korean Patent Application No. 10-2007-0073474, filed on Jul. 23, 2007, in the Korean Intellectual Property Office, and entitled: "Organic Light-Emitting Display Apparatus and Method of Driving the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Referring to FIG. 1, an OLED display apparatus according to an embodiment of the present invention includes a display unit 200, a control unit 210, a driving voltage supply unit 240 and a switching unit 250. The display unit 200 includes a plurality of pixels 260, a scan driver 220 and a data driver 230. The control unit 210 may receive a video signal and may generate a frame-based image data signal DS and a frame identification signal FS. The frame-based image data signal DS may include image data, and the frame identification signal FS may include data identifying a starting point of each frame of the image data signal DS. In operation, the display unit 200 may display an image corresponding to the image data signal DS via the plurality of pixels 260.

The control unit 210 may also generate a driving voltage control signal $CS_1$, a scan driving control signal $CS_2$ and a data driving control signal $CS_3$. The control unit 210 may supply the image data signal DS and the data driving control signal $CS_3$ to the data driver 230. The control unit 210 may further supply the scan driving control signal $CS_2$ to the scan driver 220, may supply the frame identification signal FS to the data driver 230, and may supply the driving voltage control signal $CS_1$ to the driving voltage supply unit 240.

The driving voltage supply unit 240 may receive the driving voltage control signal $CS_1$ and may supply a driving voltage to the switching unit 250 responsive to the driving voltage control signal $CS_1$. The switching unit 250 may receive the driving voltage from the driving voltage supply unit 240 and may receive the frame identification signal FS from the control unit 210. The switching unit 250 may supply a first voltage to the display unit 200 responsive to the frame identification signal FS received from the control unit 210, explained in more detail with reference to FIGS. 2-5. The driving voltage supply unit 240 may supply a second voltage to the display unit 200 responsive to the driving voltage control signal $CS_1$.

The plurality of pixel elements 260 of the display unit 200 may be located at intersections between scan lines $S_1$-$S_n$ and data lines $D_1$-$D_n$. The scan driver 220 may receive the scan driving control signal $CS_2$ from the control unit 210 and may sequentially supply scan signals to the scan lines $S_1$-$S_n$. The data driver 230 may receive the data driving control signal $CS_3$ and the image data signal DS from the control unit 210 and may supply image data to the data lines $D_1$-$D_n$.

Figure 2:
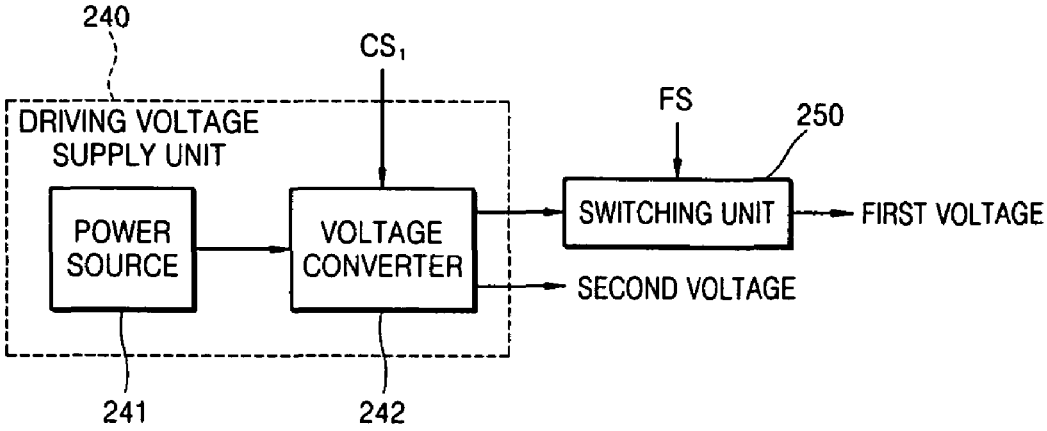
FIG. 2 illustrates a schematic block diagram of a driving voltage supply unit according to an embodiment of the present invention.

Referring to FIG. 2, the driving voltage supply unit 240 illustrated in FIG. 1 may further include a power source 241 and a voltage converter 242. The power source 241 may supply an input voltage to the voltage converter 242. The voltage converter 242 may receive the input voltage from the power source 241 and the driving voltage control signal $CS_1$ from the control unit 210 (see FIG. 1), and may generate a first voltage to be supplied to the switching unit 250. The switching unit 250 may receive the first voltage from the voltage converter 242 and may receive a frame identification signal FS from the control unit 210 (see FIG. 1). The switching unit 250 may supply the first voltage to the display unit 200 (see FIG. 1) responsive to the frame identification signal FS. For example, as will be explained in more detail later, the frame signal FS may identify a starting point of each frame of image data, and the first voltage may not be supplied to the display unit 200 during the starting point of each frame. This may result in no image being displayed on the display device 200 during the starting point of each frame. Furthermore, the voltage converter 242 may also generate a second voltage to be supplied to the display unit 200 (see FIG. 1), and may supply the second voltage to the display unit 200 (see FIG. 1). The power source 241 may be a lithium (Li) ion battery or the like, although the scope of the present invention is not so limited.

The voltages generated by the voltage converter 242 may include a first voltage to be supplied to the switching unit 250 and a second voltage. The first voltage to be supplied to the switching unit 250 may be higher than the voltage provided from the power source 241 to the voltage converter 242. Furthermore, the second voltage may be lower than the voltage provided from the power source 241, for example. The voltage converter 242 may be a DC-DC converter, a booster converter or the like, although the scope of the present invention is not so limited. Furthermore, as will be explained in more detail later, the switching unit 250 may include a switching element, a regulator or the like.

Figure 3:
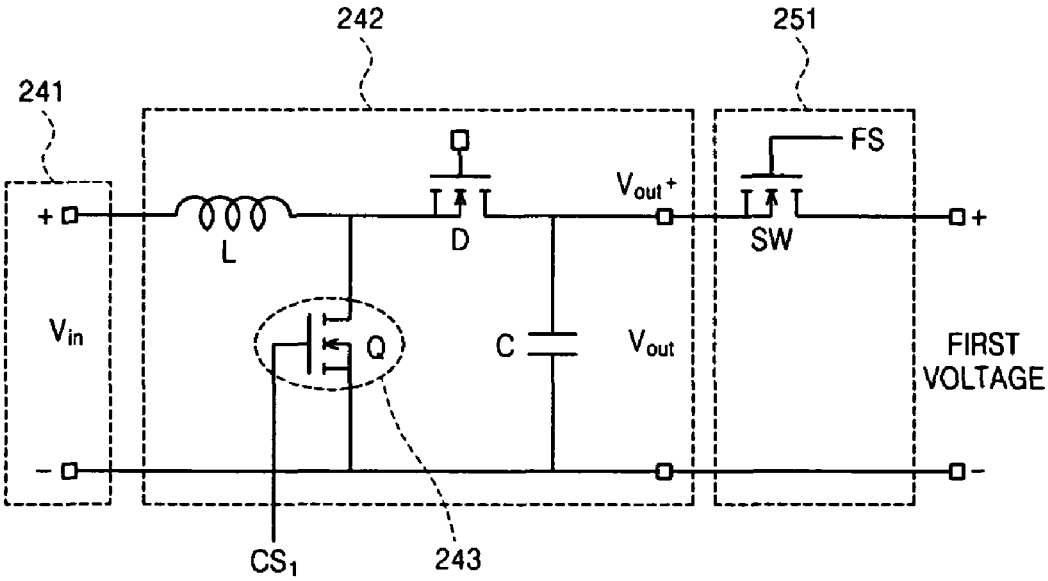
FIG. 3 illustrates an internal circuit of a voltage converter and a switching element according to an embodiment of the present invention.

Referring to FIG. 3, the voltage converter 242 as illustrated in FIG. 2 further includes a power source controller 243, a reflux diode D, an inductor L, a capacitor C and a plurality of the voltage terminals. The switching element 251 may include a switch SW and may be adapted to receive a frame identification signal FS. The switching element 251 may be connected to output terminals $V_{out}$ including $V_{out+}$ of the voltage converter 242, and may be utilized as a switching unit such as switching unit 250 of FIG. 1.

The voltage converter 242 may include a power switch Q and may receive a voltage from the power source 241 at terminals $V_{in}$. The power source controller 243 may also receive the driving voltage control signal $CS_1$ and may control the on/off state of the voltage converter 242 in response to the driving voltage control signal $CS_1$. The voltage converter 242 may be controlled by zero voltage/current switching or by pulse width modulation (PWM), as just a few examples, but the scope of the present invention is not so limited.

An output terminal of the switching element 251 may be connected to the display unit 200 (see FIG. 1). When the switching element 251 is in an "on" state in response to the frame identification signal FS, the first voltage may be supplied to the display unit 200 (see FIG. 1). When the switching element 251 is in an "off" state in response to the frame identification signal FS, the first voltage may not be supplied to the display unit 200 (see FIG. 1), resulting in the display unit not displaying an image. As stated previously, an image may not be displayed on the display unit 200 during the starting point of each frame, for example. The switching element 251 may be a MOSFET transistor or the like, although the scope of the present invention is not so limited.

Figure 4:
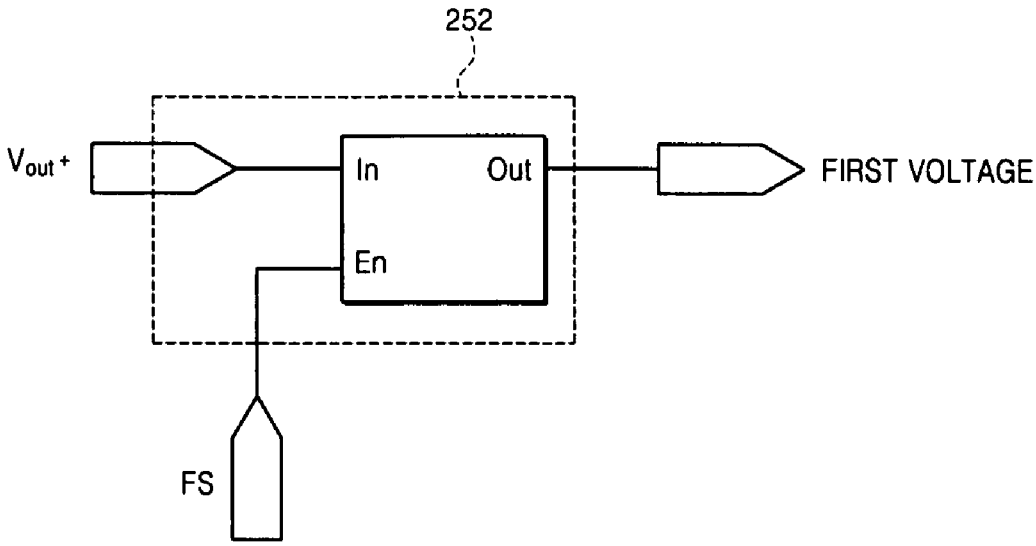
FIG. 4 illustrates a schematic block diagram of a regulator according to an embodiment of the present invention.

FIG. 4 is a schematic block diagram of a regulator 252 that may be employed as a switching unit such as switching unit 250 of FIG. 1. In FIG. 4, the regulator 252 may receive an input voltage $V_{out+}$ from the driving voltage supply unit 240 (see FIGS. 1 and 3) at terminal In, and may also receive the frame identification signal FS from the control unit 210 (see FIG. 1) at terminal En. The regulator 252 may be enabled in an "on" state or in an "off" state in response to the frame identification signal FS. In other words, when the frame signal FS identifies a starting point of a frame of image data of the image data signal DS (see FIG. 1), the regulator may be enabled in an "off" state. When the frame signal FS identifies that the image data of the image data signal DS provided to the display unit is not a starting point of a frame, the regulator 252 may be enabled in the "on" state. When enabled in an "off" state, the regulator may not output the first voltage to the display unit 200. When enabled in an "on" state, the regulator 252 may output the first voltage from an output terminal of the regulator 252 to the display unit 200 (see FIG. 1). The regulator 252 may be an LDO regulator or the like, although the scope of the present invention is not so limited.

Figure 5:
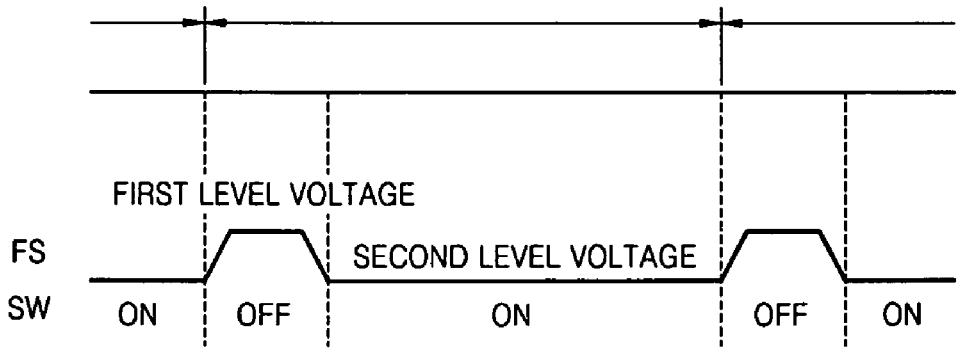
FIG. 5 illustrates a timing diagram of a frame identification signal generated in a control unit according to an embodiment of the present invention.

Referring to FIG. 5, the frame identification signal FS may be a signal generated based at least in part on the video signal received by control unit 210 (see FIG. 1). For example, the frame identification signal FS may be a signal synchronized with the image data signal DS to identify the starting point of each frame of the image data signal DS. In this sense, the frame identification signal FS may indicate a vertical blanking interval. However, the scope of the present invention is not so limited.

Typically, one frame identification signal FS may be output for each frame included in the image data signal DS. The frame identification signal FS may include a first level voltage and a second level voltage, the first and second level voltages having different potentials. As illustrated in FIG. 5, when the first level voltage of the frame identification signal FS is generated and supplied to the switching unit 250 (see FIG. 1), the switch SW of switching element 251 may be off, and the switching unit 250 may be in an "off" state or disabled. When the second level voltage of the frame identification signal FS is generated and supplied to the switching unit 250 (see FIG. 1), the switch SW of switching element 251 may be on, and the switching unit 250 may be in an "on" state or enabled. In operation, the switching may be in an "off" state if the synchronized image data signal DS is at a vertical blanking interval. Conversely, the switching unit 250 may be in an "on" state if the synchronized image data signal DS is not at a vertical blanking interval. When the frame identification signal FS is in an "off" state, a first voltage is not supplied from the switching unit 250 to the display unit 200 (see FIG. 1). Accordingly, no image may be displayed on the display unit 200, thereby displaying a black screen and preventing a motion blur phenomenon. In this manner, the frame identification signal FS may be employed to identify the starting point of each frame included in the image data signal DS.

Continuing with FIG. 5, the first level voltage may be a voltage higher than the second level voltage. In other embodiments, however, the first level voltage may be a voltage lower than the second level voltage. Furthermore, if the first level voltage is lower than the second level voltage, the switching element 251 (see FIG. 3) or a regulator 252 (see FIG. 4) may be modified in order to operate as described above, for example.

Figure 6:
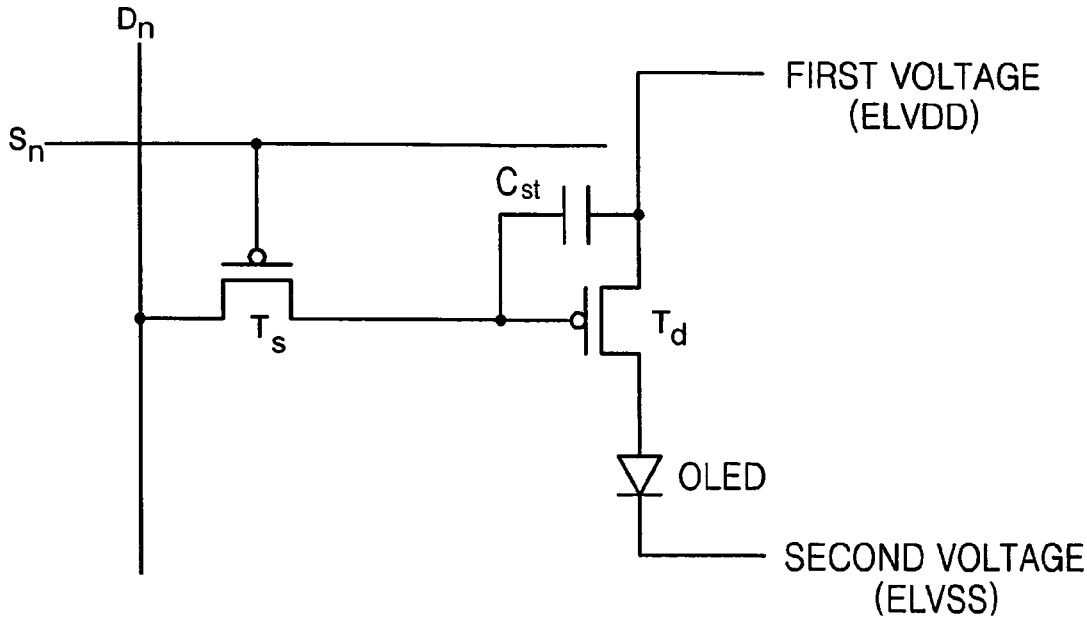
FIG. 6 illustrates a pixel circuit of an OLED display apparatus according to an embodiment of the present invention.

Referring to FIG. 6, one embodiment of a pixel circuit for a pixel element 260 of display unit 200 (see FIG. 1) is illustrated, although other configurations are possible and remain in accordance with at least one embodiment. The pixel circuit includes a driving thin film transistor $T_d$, an OLED, a capacitor $C_{st}$, and a switching thin film transistor $T_s$. The pixel circuit is coupled to data line $D_n$ and scan line $S_n$. A gate electrode of the driving thin film transistor $T_d$ may receive image data from data driver 230 (see FIG. 1). The image data may be based at least in part on the image data signal DS provided from control unit 210 (see FIG. 1), for example. A first electrode of the driving thin film transistor $T_d$ may receive a first voltage ELVDD from driving voltage supply unit 240 (see FIG. 1). A second electrode of the driving thin film transistor $T_d$ may be connected to an anode of the OLED. A cathode of the organic light-emitting diode OLED may receive a second voltage ELVSS from the driving voltage supply unit 240 (see FIG. 1).

As described above with reference to FIG. 5, when a first level voltage of a frame identification signal FS is supplied to a switching unit 250 (see FIG. 1), the first voltage from the driving voltage supply unit 240 (see FIG. 1) is not supplied to the anode of the OLED. As a result, the OLED is turned off and a black screen is displayed on a display unit 200 (see FIG. 1). When a second level voltage of the frame identification signal FS is supplied to the switching unit 250 (see FIG. 1), the first voltage from the driving voltage supply unit 240 is supplied to the anode of the OLED. As a result, the OLED emits light, and images corresponding to the image data signal DS may be displayed on the display unit 200 (see FIG. 1).

Accordingly, when the first voltage is not supplied to the OLED of the display unit 200 by disabling the switching unit 250 for a given time for a particular frame, a voltage is not supplied to the OLED and a black screen may be displayed on the display unit 200, resulting in the prevention of a motion blur phenomenon on the display unit 200.

While the present invention has been particularly shown and described with reference to exemplary embodiments thereof, it will be understood by those of ordinary skill in the art that various changes in form and details may be made therein without departing from the spirit and scope of the present invention as defined by the following claims.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light-emitting diode (OLED) display apparatus, comprising:

a control unit to receive an image signal and to generate a frame-based image data signal and a frame identification signal based at least in part on the received image signal, the frame identification signal being synchronized with the frame-based image data signal, and identifying a starting point of each frame included in the frame-based image data signal;

a driving voltage supply unit to generate a first voltage and a second voltage for driving a display unit, the driving voltage supply unit to supply the second voltage to the display unit; and a switching unit to receive the first voltage and the frame identification signal, wherein the switching unit does not supply the first voltage for driving the display unit to any pixel in the display unit during a starting point of a frame included in the frame-based image data, and supplies the first voltage for driving the display unit to a driving thin film transistor which is connected to an OLED in each pixel of the display unit when the frame identification signal indicates that the frame-based image data signal is not at a starting point of a frame.

2. The OLED display apparatus as claimed in claim 1, wherein the driving voltage supply unit comprises:

a power source to supply an input voltage to a voltage converter; and a voltage converter to convert the input voltage from the power source to a first voltage higher than the input voltage and a second voltage lower than the input voltage.

3. The OLED display apparatus as claimed in claim 1, wherein the data to identify a starting point of each frame included in the frame-based image data signal includes a voltage signal that has one of a first level voltage or a second level voltage based at least in part on the frame-based image data signal.

4. The OLED display apparatus as claimed in claim 3, wherein the switching unit is adapted to enter an "off" state in response to the frame identification signal having a first level voltage, and is adapted to enter an "on" state in response to the frame identification signal having a second level voltage.

5. The OLED display apparatus as claimed in claim 1, wherein the display unit includes a plurality of pixels.

6. The OLED display apparatus as claimed in claim 5, wherein each of the pixels comprises a driving thin film transistor to supply a current to respective OLEDs.

7. A method of driving an organic light-emitting diode (OLED) display apparatus, the method comprising:

generating a frame-based image data signal and a frame identification signal based at least in part on an image input signal, the frame identification signal identifying a starting point of each frame included in the frame-based image data signal;

providing the frame-based image data signal to a display unit;

generating a first voltage and a second voltage for driving the display unit, supplying the second voltage to the display unit; and alternating a supply of the first voltage to the display unit in response to the frame identification signal such that the first voltage is not supplied to the display unit during a starting point of a frame included in the frame-based image data, and is supplied to a driving thin film transistor which is connected to an OLED in each pixel of the display unit when the frame identification signal indicates that the frame-based image data signal is not at a starting point of a frame.

8. The method of driving an OLED display apparatus as claimed in claim 7, further comprising displaying images corresponding to the frame-based image data signal when the driving voltage is supplied to the display unit.

9. The method of driving an OLED display apparatus as claimed in claim 7, wherein the data to identify a starting point of each frame included in the frame-based image data signal includes a voltage signal that has one of a first level voltage or a second level voltage based at least in part on the frame-based image data signal.

10. The method of driving an OLED display apparatus as claimed in claim 9, wherein alternating the supply of the driving voltage further comprises not providing the driving voltage in response to the frame identification signal having a first level voltage, and providing the driving voltage in response to the frame identification signal having a second level voltage.

11. The method of driving an OLED display apparatus as claimed in claim 7, further comprising continuously supplying another driving voltage to the display unit.

* * * * *